US005445653A

United States Patent [19]

Hixson et al.

[11] Patent Number: 5,445,653

[45] Date of Patent: Aug. 29, 1995

[54] METHOD OF DYEING NYLON TO PRODUCE COLORFAST FIBER WHICH RESISTS FURTHER DYEING

[75] Inventors: Robert R. Hixson, Rossville, Ga.; Randy J. Rawlston, Hixson; Hobert C. Sweatman, Soddy, both of Tenn.

[73] Assignee: Rossville Yarn, Inc., Rossville, Ga.

[21] Appl. No.: 218,753

[22] Filed: Mar. 28, 1994

[51] Int. Cl.[6] ..... D06P 3/10; D06P 3/82; C09B 62/00

[52] U.S. Cl. ..... 8/531; 8/543; 8/549; 8/633; 8/924

[58] Field of Search ..... 8/543–549, 8/924, 633, 478, 481, 485, 531

[56] References Cited

U.S. PATENT DOCUMENTS 4,693,725 9/1987 Yamauchi et al. ..... 8/527
5,131,918 7/1992 Kelley ..... 8/549

*Primary Examiner*—Paul Lieberman
*Assistant Examiner*—Margaret Einsmann
*Attorney, Agent, or Firm*—Levine & Mandelbaum

[57] ABSTRACT

A method of dyeing nylon, particularly cationic dyeable Type 6 and 66 nylon and light dyeable Type 66 nylon, so that the dyed fiber will resist taking on further dye and will have a high degree of wash and bleed fastness when the dyed fiber is subjected to a further high temperature aqueous dye bath. The method includes providing a bifunctional dye solution having a very low pH, i.e. no higher than 1.5. The dye is applied to the fiber with a degree of wet pick-up exceeding 100% by weight of the fiber. The fiber is then steamed, washed, and dried, and contacted by an alkaline solution, such as a trisodium phosphate solution. Thereafter, the fiber is autoclaved. Such a dyed nylon fiber can be combined with an undyed nylon fiber to produce a textile product. When such a product is subjected to a dyeing operation, to provide the undyed nylon with a color different from the color of the previously-dyed fiber, the previously-dyed fiber will not bleed or wash out, and will resist taking on the dye being used to color the undyed nylon.

10 Claims, No Drawings

METHOD OF DYEING NYLON TO PRODUCE COLORFAST FIBER WHICH RESISTS FURTHER DYEING

This invention relates to dyeing polyamide fiber, and more particularly to dyeing a specific type of nylon so that the dyed fiber will resist taking on further dye and will have a high degree of wash and bleed fastness when the dyed fiber is subjected to a further high temperature aqueous dye bath.

Textile designers, especially those who create carpet and upholstery fabric designs, have a need for a pre-dyed nylon yarn which can be combined with an undyed nylon yarn to produce a textile product, such as a tufted carpet or an upholstery fabric. Such a textile product can then be subjected to a further dyeing operation so as to apply a color to the undyed nylon portion of the product which is different from the color or colors of the pre-dyed yarn. The availability of a pre-dyed nylon yarn permitting such processing would make possible styling and design effects in the finished textile product which cannot be achieved in any other way.

The problem presented is that, up to the present time, a pre-dyed nylon yarn cannot withstand exposure to typical further dyeing treatments which involve subjecting the textile product to an aqueous dyebath having a high temperature, e.g., at or near 212° F., and containing one or more surface active agents. Such exposure causes the coloring in the pre-dyed fiber to at least partially wash out and/or bleed onto the undyed yarn, compromising the final color of that yarn. In addition, the pre-dyed fiber takes on some of the color presented by the further dyeing operation, thereby altering the original color of the pre-dyed fiber.

To a small extent, this problem can be overcome by employing as the pre-dyed yarn solution-dyed nylon, i.e., nylon into which pigment is incorporated at the time the filaments are produced. The coloring in solution-dyed nylon will not wash out or bleed during further dyeing treatment. However, solution-dyed nylon yarns are available in only a few solid colors, and hence reliance on their use severely limits the creation of designs. Optimum styling effects require pre-dyed yarns, both solid color and multicolor dyed yarns, available in a wide range of colors.

In an attempt to meet this need, American Hoechst Corporation developed bifunctional fiber reactive dyes for use with nylon which are sold under the trademark Remalan. A characteristic of these dyes is that they are treated with a process Hoechst calls "previnylization" which allows them to act as both acid and fiber reactive dyes at different stages of the dyeing process. The Remalan dyes initially form an ionic bond with the amine groups in nylon fiber, similar to the bonds formed when acid dyes are applied to nylon. The nylon yarn is washed and then treated with an alkaline solution, specifically trisodium phosphate, which increases the pH of the dye and activates the fiber reactive portion of the dye. The dyed yarn is dried and then autoclaved, the high temperature and pressure, and alkaline exposure, inducing a reaction between the amine groups of the nylon and the fiber reactive portion of the Remalan dye to create covalent bonds between the dye and amine groups. Thus, the term "bifunctional" dye, as used herein is intended to refer to a dye which exhibits the characteristics of both acid dyes, in their ability to form ionic bonds, and fiber reactive dyes, in their ability to form covalent bonds. As a result of these strong ionic and covalent bonds, nylon yarn carrying Remalan dye can withstand a further dyeing process without washing out or bleeding onto adjacent nylon yarns.

However, a problem which remains when the American Hoechst technology is employed is that the amine groups, which must be available in the nylon to form ionic and covalent bonds with the Remalan dyes, remain capable of forming ionic bonds with acid, premetalized, and mordant dyes used to color the undyed nylon in the second dyeing process. Thus, if for example, a designer wishes to use a pre-dyed nylon yarn, which has been printed with red and yellow areas using Remalan dyes, so as to provide red and yellow accents in the final nylon carpeting, and the second dyeing process involves coloring the undyed nylon blue, the treatment of the carpeting with the blue dye will inevitably cause the pre-dyed Remalan red and yellow colors to become purple and green.

To aid in understanding the present invention, it should be pointed out that nylon refers to a variety of long chain, high molecular weight polyamide fibers. Two types of these fibers are of interest to the commercial textile industry, e.g., carpeting and upholstery fabrics.

Type 6 nylon is made by the polyermerization of e-caprolactam. A characteristic of this type of nylon is that it has a very open structure easily penetrated by dyestuff solutions and print pastes, and hence readily dyeable with dark shades. However, the open structure of the fiber makes it more susceptible to having the dye washed out of it, and hence gives the fiber relatively poor washfastness properties. Major producers of Type 6 nylon in the United States are Allied-Signal Corp. and BASF Corp.

Type 66 nylon is produced by the polymeric reaction between hexamethyline diamine and adipic acid. This results in a hydrophilic but much more closed fiber structure and hence slower than Type 6 nylon to absorb dye solutions and print pastes. Consequently, it is more difficult to dye Type 66 nylon with dark shades. However, the tighter structure of the fiber gives it much better wash and bleed fastness than is obtained when Type 6 nylon is used. Major producers of Type 66 nylon are E.I. dupont and Monsanto Corp.

In addition to the differences in dye absorption properties caused by the different degrees of openness of the fiber structures, each nylon manufacturer has offered for commercial sale a range of nylon yarns which have been modified to accept different depths of colors. The modification involves the number of reactive groups, or amine ends, which are introduced into the fiber when it is originally spun or produced. The number of amine groups may vary with different yarn producers, but a typical index is as follows: deep dyeable nylon, i.e., that capable of being dyed to very deep shades, may have an index number of 75, indicating the relatively high proportion of amine groups in the yarn; regular nylon may have an index number of 40; light dyeable nylon may have an index number of 18; and cationic dyeable nylon will have an index number of 0. With reference to cationic dyeable nylon, the index number of 0 does not indicate that there are no amine groups in the nylon. The nylon does contain amine groups, but by adding sulfonic acid to the fiber during the manufacturing process, the amine groups are effectively neutralized leaving the fibers with a negative charge which causes them to resist acid dyes and to form ionic bonds with cationic dyes.

The Remalan dyes of American Hoechst Corporation can be used successfully with deep dyeable, regular, and light dyeable Type 6 nylon as well as deep dyeable and regular Type 66 nylon. However, Remalan dyes do not provide good color yield when used with light dyeable Type 66 nylon. Since deep dyeable, regular, and light dyeable Type 6 nylon, and deep dyeable and regular Type 66 nylon have relatively high contents of amine ends, these fibers, when pre-dyed do not react well when subjected to a second dyeing operation. Specifically, when these pre-dyed fibers are subjected to a second dyeing operation with acid, premetalized, and mordant dyes, which are used to dye the undyed nylon in the textile product by means of high temperature aqueous dye solutions, the pre-dyed colors tend to be stained by these dyes and hence the original color is compromised. Thus, it will be seen that the very fibers with which Remalan dyes work effectively are those which cannot be successfully used in textile products which must undergo a second dying operation.

Therefore, in order to provide a maximum range of textile design possibilities, it would be desirable to be able to apply bifunctional dyes, such as Remalan dyes, to cationic dyeable nylon, since such fiber has no available amine ends and hence will resist taking on acid, premetalized, or mordant dyes during a second dying operation.

It may be mentioned that recently Monsanto Corp. has introduced a nylon yarn treated with lesser amounts of sulfonic acid. As a result, this yarn is not totally cationic dyeable nylon because it contains some available amine groups. The yarn is referred to as light cationic or "half cat" nylon. However, because it is the tighter structured Type 66 nylon, and the fact that it falls between light dyeable and cationic dyeable nylon, in terms of its available amine ends, it cannot be successfully dyed by Remalan dyes. Since the behavior of light cationic nylon and cationic dyeable nylon are similar with respect to their resistance to dying by Remalan dyes, both of these types of nylon will be referred to in the present disclosure as cationic dyeable nylon.

It is object of the present invention to provide a method of dyeing nylon, especially cationic dyeable Type 6 and Type 66 nylon and light dyeable Type 66 nylon, so that the dyed fiber will resist taking on further dye, and will have a high degree of wash and bleed fastness, when the dyed fiber is subjected to a further high temperature aqueous dye bath.

According to the present invention, Remalan dye, or a fiber reactive dye which has been previnylized, is treated to adjust its pH to produce a very acidic dye solution or print paste. The dye solution or print paste is then applied to a cationic dyeable nylon or light dyeable Type 66 nylon with a degree of wet pick-up exceeding 100% by weight of the fiber. The yarn is then steamed, scoured, and dried, after which it is contacted with an alkaline solution. The alkaline solution could be applied prior to drying. However, better results have been achieved by employing the alkaline solution after drying the yarn. Finally, the yarn is autoclaved.

Nylon yarn dyed by this method exhibits superior high temperature wetfastness and resistance to dyeing during a secondary dyeing operation.

It is believed that the bifunctional characteristics of Remalan fiber reactive dyes are greatly increased by previnylization. Fiber reactive dyes have the ability to form covalent bonds with the amine groups in nylon. The previnylization step gives the fiber reactive dye the ability to also form ionic bonds with the amine groups in the nylon. In previnylization, the dye is dissolved in water at about 190° F. An alkali, preferably trisodium phosphate is added to adjust the pH of the solution to the range of 9.0 to 9.5, and the dye is mixed for about ten minutes. Acid is then added to lower the pH of the solution.

According to the present invention, sufficient acid is added to the dye solution to make it extremely acidic, i.e., to reduce its pH to no higher than 1.5, and preferably to the range of 0.5 to 1.5. It is believed that reduction to this very low pH range is instrumental in giving the dye the ability to color cationic dyeable and light dyeable Type 66 nylon, which otherwise cannot be successfully dyed by Remalan dyes.

Other constituents may be added to the dye solution, such as a gum or thickener, wetting agents, penetrating agents, and anti-foaming agents, and mixed to provide a homogeneous dye solution or print paste.

The method of the present invention has been tested by dying cationic dyeable nylon with the entire line of Remalan dyes. It has been found that some of these dyes yield better results than others. Those Remalan dyes which have performed optimally are the following:

Yellow C-3G
Yellow C-4R
Red C-J
Blue C-B
Blue C-RB
Red C-4B
Blue C-2G

It is believed that fiber reactive dyes from other manufacturers will perform well with the present invention, especially if they are previnylized so as to make them into bifunctional dyes, similar to Remalan dyes.

After the very acidic dye solution or print paste is prepared, as described above, the dye may be applied to nylon yarn in warp or single end form, in coil form, or in knit-deknit form. A light base shade may be applied after which the yarn is passed through a squeeze roll to insure uniform dye pick-up.

If the yarn is in warp or coil form, the dye solutions are applied by passing the yarn through or under one or more high saturation spray heads to an extremely high degree of wet pick-up. The wet pick-up should exceed 100%, and preferably is within the range of 200% to 350%. The percentage of wet pick-up is intended to refer to the weight of the dye solution held by the yarn as compared to the weight of the yarn to which it is applied. Thus, a degree of wet pick-up of 100% means that the weight of the dye solution equals the weight of the nylon, and a degree of wet pick-up of 200% means that any unit length of yarn has been treated with an amount of dye solution weighing twice the weight of that unit length of yarn, i.e., every pound of yarn carries two pounds of dye solution. The spray heads used to apply the dye may be stationary, to give solid dyeing effects, or they may oscillate to give broken pattern effects.

If the yarn is in knit tubing form, the thickened dye solutions, i.e. print pastes, may be applied by a print roll at an extremely high degree of wet pick-up. If solid shades are desired, the dye solutions may be applied by high saturation spray heads to the yarns or knit tubing at extremely high saturation degrees of wet pick-up and no pattern effects will result. In all cases, after the high saturation wet pick-up is obtained, the yarns are passed directly into the steamer and are not passed through any additional squeeze or nip process. Steaming may be performed in a conventional continuous apron steamer, and may be carried on for between one and ten minutes, depending upon the particular nylon used and the particular dye involved.

During the steaming operation, the Remalan dyes form an ionic bond with the nylon. The extremely low pH of the dye solution allows some of the inherent amine ends which are contained in the cationic dyeable and light dyeable nylon to become available for bonding with the dye. Moreover, if the degree of wet pick-up of the dye on the yarn is sufficiently high, enough of the dye will be retained throughout the scouring operation to yield deep shades even on cationic dyeable nylon.

After steaming, the dyed yarns are washed, such as by passing through conventional wash boxes, to remove residual dyes and chemicals. After washing, the yarn is dried.

The dried yarns may then be skeined preparatory to autoclaving. During the skeining, or reeling, operation an alkali, such as trisodium phosphate, is sprayed on to the yarn to saturate the yarn with the alkaline solution. This procedure raises the pH of the yarns to a level of about 10.5 or higher. Application of the alkaline solution tends to activate the fiber reactive portion of the dye.

American Hoechst Corporation recommends treating the yarn with alkali in the last washbox, i.e., before drying the yarn. In contrast, according to the present invention, the alkali is applied on the reeler, after the yarn is dried. Application of the alkaline solution to the yarn after it is dried has a number of advantages:

(1) it is difficult to maintain a constant level of pH in the washbox;
(2) alkalinity is lost during the drying operation; and
(3) an alkali, especially trisodium phosphate, when applied in the washbox and then dried on the yarn will produce a messy powder during the skeining operation, and as a result additional alkalinity will be lost due to the powder falling as dust from the yarn.

The alkali-permeated yarn is autoclaved, preferably at about 275° F. and 30 psi. This high temperature and pressure exposure causes the Remalan dye to form covalent bonds with the available amine ends in the nylon to which the dye is already attached by ionic bonds. While the temperature and pressure for autoclaving mentioned above work successfully, autoclaving at any temperature and pressure may result in the formation of some covalent bonds.

The following examples further illustrate the present invention:

EXAMPLE 1

3.0 G/L (grams per liter) Remalan Blue CRB was dissolved in water at 190° F. After thorough dissolution, 0.840 G/L trisodium phosphate (TSP) was added and the dye was previnylized by mixing for 10 minutes. The pH of the solution was 9.6. After previnylization, the following chemicals were added and the solution agitated:

0.05 lbs/Gal guar thickener
0.08 lbs/Gal thiodiglycol (dye dispersing agent)
0.125 lbs/Gal Hostaspur CX (wetting agent)
0.03 lbs/Gal sulfamic acid.

The sulfamic acid had the effect of reducing the pH of the dye solution to 1.45.

The dye was applied to a knit tubing of 1360/1 Type JBJ (cationic dyeable) Monsanto nylon by padding the knit tubing through the thickened dye solution and nipping the yarn through a squeeze roll at 10 psi pressure. The knit tubing was steamed for 8 minutes at 212° F., washed in clean water at 140° F., and dried. Thereafter, the knit tubing was sprayed with a TSP solution to raise its pH to 10.4, and autoclaved at 275° F. and 30 psi for 20 minutes. The tubing was deknitted and the resultant yarn was found to be dyed to a medium blue shade.

To test the bleed fastness properties of the dyed yarn, 2.5 grams of the blue yarn were placed in a beaker with 7.5 grams of undyed regular Monsanto nylon. The following chemicals were added:

2.0% artionic retarding agent
1.0% non-ionic wetting agent
0.25% acetic acid to adjust pH to 5.5–6.0

The yarns were kept at 212° F. for 30 minutes, rinsed, and dried. Evaluation of the yarns showed that the blue yarn experienced no color change and the white regular nylon was not stained by the blue dye.

To test the overdye resistant properties of the dyed yarn, the procedure outlined above to test bleed fastness was repeated, except that. 0.30% by weight of Nylanthrene Yellow FLW (Acid Yellow 159) was added to the bath. After boiling for 30 minutes, the regular dye nylon was dyed to a medium yellow shade, but the pre-dyed nylon still exhibited a clear medium blue shade which was not stained by the acid yellow dye.

EXAMPLE 2

The procedure of Example 1 was repeated except that the yarn was dyed with the following combination shade:

3.0 G/L Remalan Red C-J
1.08 G/L Remalan Yellow C-4R

A bright medium red shade was obtained. Results of the dye test and overdye test showed that no dye bleeding occurred and the pre-dyed yarn was not stained by the acid dyes used to dye the regular dye nylon.

EXAMPLE 3

Packages of single end 3.40/2 BASF Wrap Spun cationic dyeable nylon were run through a coiler and deposited on the apron of a continuous coil dyeing machine. A light base solid shade was sprayed to 100% saturation of the yarn and the yarns were squeezed through a pressure roll at 20 psi. The solid shade was prepared by combining the following dyes:

0.005 lbs/Gal Remalan Yellow C-3G
0.0002 lbs/Gal Remalan Red C-4B
0.0002 lbs/Gal Remalan Blue C-2G The dye was previnylized by mixing for 10 minutes with TSP at a pH of 9.5. The following chemicals were added:

0.02 lbs/Gal thiodiglycol
0.06 lbs/Gal sulfamic acid to adjust pH to 1.5
0.06 bs/Gal Hostaspur CX The coiled yarn was then passed under four oscillating spray heads and the following dye solutions were sprayed on to the yarns.

Head #1
0.006 lbs/Gal Remalan Yellow C-3G
0.0006 lbs/Gal Remalan Red C-4B
0.0004 lbs/Gal Remalan Blue C-2G
0.02 lbs/Gal T-D-G 0.04 lbs/Gal Hostaspur CX Dye was previnylized with TSP at pH=9.5 and thereafter the pH was adjusted to 1.4 with sulfamic acid.

Head #2
0.006 lbs/Gal Remalan Red C-4B
0.005 lbs/Gal Remalan Blue C-2G
0.02 lbs/Gal T-D-G
0.04 lbs/Gal Hostaspur CX Dye was previnylized with TSP at pH=9.5 and thereafter the pH was adjusted to 1.2 with sulfamic acid.

Head #3
0.0126 lbs/Gal Remalan Yellow C-3G
0.0016 lbs/Gal Remalan Red C-4B
0.0064 lbs/Gal Remalan Blue C-2G
0.02 lbs/Gal T-D-G
0.04 lbs/Gal Hostaspur CX Dye was previnylized with TSP at pH=9.6 and thereafter the pH was adjusted to 1.4 with sulfamic acid.

Head #4
0.01 lbs/Gal Remalan Yellow C-3G
0.0066 lbs/Gal Remalan Red C-4B
0.0032 lbs/Gal Remalan Blue C-2G
0.02 lbs/Gal T-D-G
0.04 lbs/Gal Hostaspur CX Dye was previnylized with TSP at a pH of 9.5 and thereafter the pH was adjusted to 1.5 with sulfamic acid. The spray velocity of Heads #1 through #4 were preset to give a random pattern effect with a wet pick-up of about 250% for each color.

The coiled yarns were run directly into a steamer without squeezing and were steamed for 1.6 minutes. The coiled yarns were spray washed at 140° F., and dried at 280° F. The yarns were uncoiled and reeled into skeins. A solution of dissolved TSP with a pH of 10.5 was sprayed on to the yarns during the reeling operation. The skeined yarns were then autoclaved at 275° F. and 30 psi for about 25 minutes.

The finished yarns were dyed to a multicolor combination containing purple, brown, dark green, light green, and light tan shades. Exposure of these yarns to the 212° F. overdye test and dye bleeding test described in Example 1 resulted in no dye bleed on to the regular nylon yarns and no staining of the pre-dyed yarn by acid, dyes.

EXAMPLE 4

The procedure of Example 3 was repeated except that the coiled yarn was 1360/1 JBJ (cationic dyeable) Monsanto nylon and the dye formulations were as follows:

Solid Base Shade
0.002 lbs/Gal Remalan Yellow C-3G
0.004 lbs/Gal Remalan Blue C-B Head #1
0.03 lbs/Gal Remalan Blue C-RB Head 2
0.02 lbs/Gal Remalan Yellow C-3G
0.0008 lbs/Gal Remalan Red C-J Head #3
0.025 lbs/Gal Remalan Yellow C-4R
0.03 lbs/Gal Remalan Red C-J Head #4
0.0113 lbs/Gal Remalan Yellow C-3G
0.009 lbs/Gal Remalan Blue C-B
0.0054 lbs/Gal Remalan Blue C-RB The resultant yarn was dyed to dark bright blue, red, yellow, mint green and light green shades. This yarn performed very well in the overdye and dye bleeding tests described in Example 1, with no stain on the undyed regular nylon yarn and no acid dye stain on the pre-dyed yarn.

EXAMPLE 5

The procedure of Example 3 was repeated except that the coiled yarn was 1360/1 Light Cationic (Half Cat) Monsanto nylon and the dye formulations were as follows:

Solid Base Shade
0.0075 Remalan Yellow C-3G
0.0003 Remalan Red C-J

Head #1
0.0168 Remalan Blue C-RB

Head #2
0.015 Remalan Yellow C-3G
0.0006 Remalan Red C-J

Head #3
0.0138 Remalan Yellow C-4R
0.0168 Remalan Red C-J

Head #4
0.0084 Remalan Yellow C-3G
0.0067 Remalan Blue C-B
0.004 Remalan Blue C-RB The resultant yarns were dyed to dark blue, orange, yellow, mint green and light yellow shades. This yarn performed well in the overdye and dyebleeding tests of Example 1 with no stain on the undyed regular nylon yarn and no acid dye stain on the pre-dyed yarn.

EXAMPLE 6

The procedure of Example 3 was followed except that the yarn was 1360 denier Type JBJ Monsanto Cationic Dyeable filament nylon. The ,objective was to dye a medium gold solid shade. The following chemicals were used:

0.02 lbs/Gal thiodiglycol
0.02 lbs/Gal Hostaspur CX
0.04 lbs/Gal sulfamic acid

The dye formulation was as follows:
0.007 lbs/Gal Remalan Yellow C-4R
0.00045 lbs/Gal Remalan Red C-J
0.00113 lbs/Gal Remalan Blue C-RB The pH of the dye solution was 1.68. After processing, the yarn was dyed to a flat beige shade.

An additional 0.03 lbs/Gal of sulfamic acid was added to the dye solution and the pH was checked at 1.30. The yarn was reprocessed with a dye add. Dropping the pH from 1.68 to 1.30 caused an additional dye yield of about 200% and the desired medium gold shade was obtained.

This example indicates the importance of adjusting the pH of the dye to a value no higher than 1.5 in order to achieve good color yield on the nylon.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

We claim:

1. A method of dyeing cationic dyeable Type 6 and 66 nylon and light dyeable Type 66 nylon, so that the dyed fiber will resist taking on further dye and will have a high degree of wash and bleed fastness when the dyed fiber is subjected to a further high temperature aqueous dyebath, the method comprising the steps of:

providing a bifunctional fiber reactive dye solution capable of forming both ionic and covalent bonds with the amine groups of tile fiber, the dye solution having a pH no higher than 1.5, applying the dye to the fiber with a degree of wet pick up exceeding 100% by weight of the fiber, contacting the fiber with an alkaline solution, and thereafter autoclaving the fiber.

2. A method as defined in claim 1 including the steps of steaming, washing, and drying the fiber prior to contacting the fiber with the alkaline solution.

3. A method as defined in claim 1 wherein the fiber is contacted with the alkaline solution before autoclaving by spraying it directly onto the fiber during the skeining or reeling operation.

4. A method as defined in claim 1 wherein the bifunctional fiber reactive dye is previnylized.

5. A method as defined in claim 1 wherein the alkaline solution is a trisodium phosphate solution.

6. A method as defined in claim 1 wherein the pH of the dye solution is between 0.5 and 1.5.

7. A method as defined in claim 1 wherein the dye is applied to the fiber with a degree of wet pick-up of at least 200% by weight of the nylon.

8. A method as defined in claim 7 wherein the degree of wet pick-up is between 200% and 350%.

9. A method as defined in claim 1 including the steps of combining the fiber dyed by the method set forth in claim 1 with an undyed polyamide fiber to produce a textile product, and then contacting the textile product with an aqueous dye bath having a color different from that of the color of the bifunctional fiber dye solution.

10. A method of dyeing cationic dyeable Type 6 and 66 nylon and light dyeable Type 66 nylon, so that the dyed fiber will resist taking on further dye and will have a high degree of wash and bleed fastness when the dyed fiber is subjected to a further high temperature aqueous dyebath, the method comprising the steps of:

providing a bifunctional fiber reactive dye solution capable of forming both ionic and covalent bonds with the amine groups of the fiber, the dye solution having a pH no higher than 1.5, applying the dye to the fiber with a degree of wet pick-up exceeding 100% by weight of the fiber, steaming, washing, and drying the fiber, thereafter spraying an alkaline solution directly onto the fiber during the skeining or reeling operation, and thereafter autoclaving the fiber.

* * * * *